United States Patent [19]

Mizukura et al.

[11] Patent Number: 5,071,738

[45] Date of Patent: Dec. 10, 1991

[54] SILVER HALIDE PHOTOGRAPHIC MATERIAL

[75] Inventors: Noboru Mizukura; Hakubun Ohashi; Shuichi Sugita, all of Hino, Japan

[73] Assignee: Konica Corporation, Tokyo, Japan

[21] Appl. No.: 480,264

[22] Filed: Feb. 15, 1990

[30] Foreign Application Priority Data

Feb. 17, 1989 [JP] Japan ..... 1-38711

[51] Int. Cl.[5] ..... G03C 1/38

[52] U.S. Cl. ..... 430/546; 430/627

[58] Field of Search ..... 430/546, 548, 627

[56] References Cited

U.S. PATENT DOCUMENTS 4,362,812 12/1982 Minamizono et al. ..... 430/528

4,656,124 4/1987 Komamura ..... 430/548

4,874,689 10/1989 Yamanouchi et al. ..... 430/548

*Primary Examiner*—Charles L. Bowers, Jr.

*Assistant Examiner*—Janet C. Baxter

*Attorney, Agent, or Firm*—Jordan B. Bierman

[57] ABSTRACT

The present invention relates to a silver halide photographic material that has at least one photographic constituent layer on a support, which photographic material is characterized in that said at least one photographic constituent layer contains a dispersion obtained by emulsifying and dispersing at least one hydrophobic, photographically useful material and at least one polymer compound that is water-insoluble but soluble in organic solvents and which has a phenolic hydroxyl group.

8 Claims, No Drawings

SILVER HALIDE PHOTOGRAPHIC MATERIAL

BACKGROUND OF THE INVENTION

The present invention relates to a silver halide photographic material, particularly to a silver halide photographic material that is improved in color forming ability, storage stability of dye image and film properties.

The most common method of forming dye images with silver halide color photographic materials is to form dyes by the reaction between photographic couplers and the oxidation product of color developing agents. For ordinary color reproduction, magenta, yellow and cyan couplers are used as photographic couplers, and aromatic primary amino color developing agents are used as color developing agents to form azomethine dyes, indoaniline dyes and other dyes. The couplers described above are usually incorporated in separate light-sensitive layers in superposition. Besides these light-sensitive layers, non-light-sensitive layers and protective layers also contain anti-color mixing agents, ultraviolet (uv) absorbers and other additives with a view to improving the quality of image and the storage stability of dye image.

Thus, many additives are incorporated in silver halide photographic materials in order to have silver halides exhibit their characteristics to the fullest extent. The additives incorporated in silver halide photographic materials are versatile in water solubility and range from water-soluble to water-insoluble compounds. Examples of "hydrophobic" compounds which are insoluble or slightly soluble in water include dye image forming couplers, ultraviolet absorbers, antifading agents, anti-color mixing agents, redox compounds and anti-foggants. In order to incorporate these hydrophobic compounds into hydrophilic colloidal layers, they must be finely dispersed to form an emulsion of an oil-in-water or "oil protected" type. While several methods have been proposed to disperse hydrophobic compounds, one approach is to disperse them in the presence of surfactants together with organic solvents such as dibutyl phthalate and tricresyl phosphate, as described in U.S. Pat. Nos. 2,322,027, 2,835,579, 3,748,141, JP-B-54-24288 (the term "JP-B" as used herein means an "examined Japanese patent publication") and JP-A-56-114940 (the term "JP-A" as used herein means an "unexamined published Japanese patent application"), and another approach is to disperse hydrophobic compounds together with polymer compounds, as described in U.S. Pat. Nos. 2,772,163, 2,852,382 and JP-A-51-25133.

These methods, however, have been found to be unsatisfactory in one way or another. For instance, they cause deterioration in color forming ability and lightfastness. Even if these problems can be avoided, dye images, when stored in a humid condition, will deteriorate in the gloss of film surface. The deterioration in color forming ability has been particularly great when developers that do not contain benzyl alcohol are used. As for the method that disperses hydrophobic compounds together with polymer compounds, the deterioration of color forming ability can be prevented to some extent by increasing the proportion of hydrophilic monomers such as acrylic acid but the improvement is still insufficient to produce completely satisfactory light-sensitive materials.

JP-A-63-44658 describes an invention that intends to improve the storage stability of image by dispersing a specific dye image forming coupler together with a polymer compound in the absence of a high-boiling point organic solvent. This methods is effective to some extent in improving the storage stability of image but on the other hand, it causes a substantial deterioration in color forming ability.

SUMMARY OF THE INVENTION

An object, therefore, of the present invention is to provide a silver halide photographic material that is high in both color forming ability and storage stability of image.

Another object of the present invention is to provide a silver halide photographic material that exhibits satisfactory color forming ability even if it is processed with a color developer that is substantially free of benzyl alcohol.

A further object of the present invention is to provide a silver halide photographic material that has high film strength and that will not experience any deterioration in the gloss of film surface even if it is stored in a humid condition.

These objects of the present invention can be attained by a silver halide photographic material that has at least one photographic constituent layer on a support, which photographic material is characterized in that said at least one photographic constituent layer contains a dispersion of at least one hydrophobic, photographically useful material and at least one polymer compound that is water-insoluble but soluble in organic solvents and which has a phenolic hydroxyl group.

DETAILED DESCRIPTION OF THE INVENTION

One important aspect of the present invention is to use a polymer compound that is water-insoluble but soluble in organic solvents and which has a phenolic hydroxyl group (this is hereinafter referred to as the "polymer compound of the present invention".) The pKa of the phenolic hydroxyl group in the polymer compound of the present invention is not limited to any particular value but it is preferably within the range of from 6 to 11, with the range of 6.5–10.5 being particularly preferred. A monomer that is preferably used to form the polymer compound of the present invention is represented by the following general formula (I):

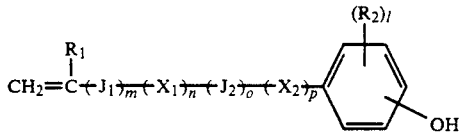

(I)

where $R_1$ is a hydrogen atom, an alkyl group of 1–4 carbon atoms or a hydrogen atom; $R_2$ is a monovalent substituent; $X_1$ and $X_2$ are each

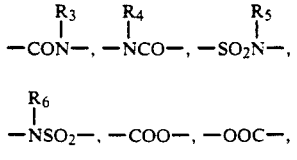

-continued $$-SO_2-,\ -CO-,\ -\overset{\overset{R_7}{|}}{\underset{\underset{R_8}{|}}{C}}-\ \text{or}\ -O-$$

provided that $R_3$, $R_4$, $R_5$, $R_6$, $R_7$ and $R_8$ each represents a hydrogen atom or an alkyl group; $J_1$ and J2 are each an alkylene group, an arylene group or an aralkylene group; l is an integer of 0–4; m, n, o and p are each an integer of 0 or 1.

Examples of the alkyl group having 1–4 carbon atoms that is represented by $R_1$ in the general formula (I) include methyl, ethyl, propyl and butyl groups, and examples of the halogen atom represented by $R_1$ include fluorine, chlorine and bromine atoms. Examples of the monovalent substituent represented by $R_2$ include: an alkyl group such as methyl, ethyl, propyl or t-butyl; a nitro group; a cyano group; an alkoxy group such as ethoxy; an acyloxy group such as acetoxy; an acylamino group such as acetylamino; a sulfonamido group such as methanesulfonamido; a sulfamoyl group such as methylsulfamoyl; a halogen atom such as fluorine, chlorine or bromine; a carbamoyl group such as methylcarbamoyl; an alkoxycarbamoyl group such as methoxycarbamoyl; and a sulfonyl group such as methylsulfonyl. If l is an integer of 2 or more, these substituents may be the same or different.

The alkyl group represented by $R_3$ to $R_8$ is preferably one having 1 to 6 carbon atoms and may be exemplified by methyl, ethyl, propyl, iso-propyl, sec-butyl, hexyl, etc.

Examples of the alkylene group represented by $J_1$ and $J_2$ in the general formula (I) include methylene, ethylene, butylene and 1-methylethylene, and examples of the arylene group represented by $J_1$ and $J_2$ include phenylene and naphthylene. An example of the aralkylene group represented by $J_1$ and $J_2$ is methylenephenylene. The alkylene, arylene and aralkylene groups may each have a substituent represented by $R_2$.

The following are specific but non-limiting examples of the monomers capable of forming the polymer compounds of the present invention.

(1)

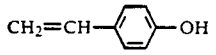

(2)

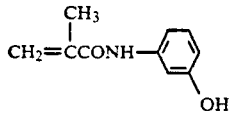

(3)

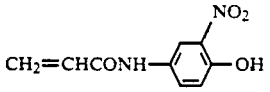

(4)

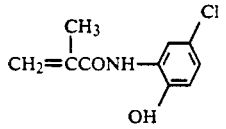

(5)

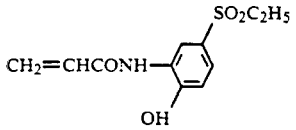

-continued (6)

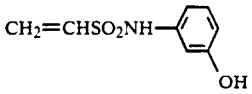

(7)

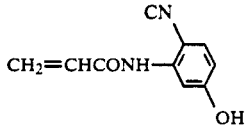

(8)

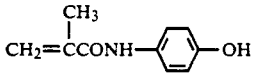

(9)

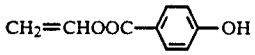

(10)

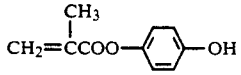

(11)

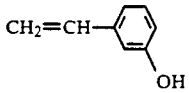

(12)

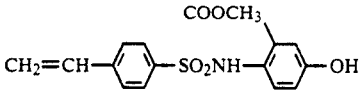

(13)

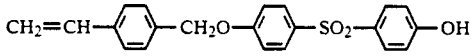

(14)

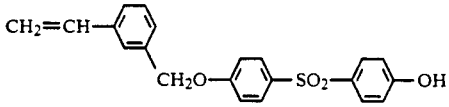

(15)

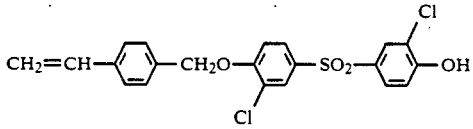

(16)

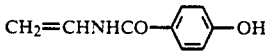

(17)

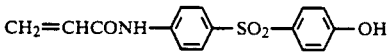

(18)

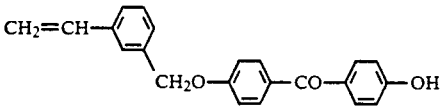

(19)

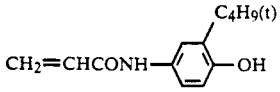

(20)

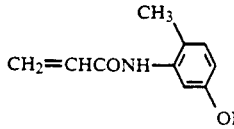

The polymer compound of the present invention may be a homopolymer of the monomer represented by the general formula (I) or it may be a copolymer of two or more of such monomers. If desired, it may be a copolymer of these monomers with other monomers. Monomers that are preferably used to form copolymers with the monomer represented by the general formula (I) include acrylates, methacrylates, acrylamides and methacrylamides. Specific examples of the monomers capable of forming copolymers with the monomer represented by the general formula (I) are described below.

Illustrative acrylate esters include: methyl acrylate, ethyl acrylate, isopropyl acrylate, butyl acrylate, t-butyl acrylate, amyl acrylate, hexyl acrylate, 2-ethylhexyl acrylate, t-octyl acrylate, 2-chloroethyl acrylate, 4-chlorobutyl acrylate, cyanoethyl acrylate, 2-acetoxyethyl acrylate, dimethylaminoethyl acrylate, methoxybenzyl acrylate, cyclohexyl acrylate, tetrahydrofurfuryl acrylate, phenyl acrylate, 2,2-dimethyl-3-hydroxypropyl acrylate, 2-methoxyethyl acrylate, 2-ethoyethyl acrylate, 2-i-propoxy acrylate, 2-(2-methoxyethoxy)ethyl acrylate, ω-methoxypolyethylene glycol acrylate (number of added moles, n=9), and 1-bromo-2-methoxyethyl acrylate.

Illustrative methacrylate esters include: methyl methacrylate, ethyl methacrylate, propyl methacrylate, butyl methacrylate, isobutyl methacrylate, amyl methacrylate, cyclohexyl methacrylate, benzyl methacrylate, octyl methacrylate, sulfopropyl methacrylate, N-ethyl-N-phenylaminoethyl methacrylate, dimethylaminophenoxyethyl methacrylate, furfuryl methacrylate, phenyl methacrylate, cresyl methacrylate, naphthyl methacrylate, 2-hydroxyethyl methacrylate, triethyleneglycol monomethacrylate, 2-methoxyethyl methacrylate, 2-acetoxyethyl methacrylate, 2-ethoxyethyl methacrylate, 2-(2-methoxyethoxy)ethyl methacrylate, ω-methoxypolyethylene glycol methacrylate (number of added moles, n=6), etc.

Illustrative vinyl esters include: vinyl acetate, vinyl propionate, vinyl butyrate, vinyl isobutyrate, vinyl caproate, vinyl chloroacetate, vinyl methoxyacetate, vinyl phenyl acetate, vinyl benzoate, vinyl salicylate, etc.

Illustrative acrylamides include: acrylamide, ethyl acrylamide, propyl acrylamide, butyl acrylamide, t-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, β-cyanoethyl acrylamide, N-(2-acetoacetoxyethyl)acrylamide, diacetone acrylamide, etc.

Illustrative methacrylamides include: methacrylamide, methyl methacrylamide, ethyl methacrylamide, propyl methacrylamide, butyl methacrylamide, t-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, β-cyanoethyl methacrylamide, N-(2-acetoacetoxyethyl)methacrylamide, etc.

Other copolymerizable monomers include: olefins such as dicyclopentadiene, ethylene, propylene, 1-butene, 1-pentene, vinyl chloride, vinylidene chloride, isoprene, chloroprene, butadiene, 2,3-dimethylbutadiene, etc.; styrenes such as styrene, methylstyrene, trimethylstyrene, ethylstyrene, chloromethylstyrene, methoxystyrene, chlorostyrene, dichlorostyrene, methyl vinylbenzoate, etc.; crotonic acid esters such as butyl crotonate, hexyl crotonate, etc.; diesters of itaconic acid such as dimethyl itaconate, diethyl itaconate, dibutyl itaconate, etc.; diesters of maleic acid such as diethyl maleate, dimethyl maleate, dibutyl maleate, etc.; diesters of fumaric acid such as diethyl fumarate, dimethyl fumarate, dibutyl fumarate, etc.

Other comonomers that can be used are listed below: allyl compounds such as allyl acetate, allyl caproate, allyl laurate, allyl benzoate, etc.; vinyl ethers such as methyl vinyl ether, butyl vinyl ether, methoxyethyl vinyl ether, dimethylaminoethyl vinyl ether, etc.; vinyl ketones such as methyl vinyl ketone, phenyl vinyl ketone, methoxyethyl vinyl ketone, etc.; vinyl heterocyclic compounds such as vinylpyridine, N-vinylimidazole, N-vinyloxazolidone, N-vinyltriazole, N-vinylpyrrolidone, etc.; glycidyl esters such as glycidyl acrylate, glycidyl methacrylate, etc.; unsaturated nitriles such as acrylonitrile, methacrylonitrile, etc.

The polymer compound of the present invention may contain an acid group containing monomer to the extent that will not render said polymer water-soluble. If an acid group containing monomer is to be contained, its content is preferably not more than 20 wt% of the polymer compound. The pKa of the acid group containing monomer is preferably not more than 6.

Examples of the acid group containing monomer include: acrylic acid, methacrylic acid, itaconic acid, maleic acid, a monoalkyl ester of itaconic acid, a monoalkyl ester of maleic acid, citraconic acid, styrenesulfonic acid, vinylbenzylsulfonic acid, acryloyloxyalkylsulfonic acid, methacryloyloxyalkylsulfonic acid, acrylamidealkylsulfonic acid, methacrylamidealkylsulfonic acid, acryloyloxyalkyl phosphate, methacryloyloxyalkyl phosphate, etc. These acids may be in the form of salts of alkali metals (e.g. Na or K) of ammonium ion.

The polymer compound of the present invention can be prepared by solution polymerization, bulk polymerization, suspension polymerization or emulsion polymerization. Initiators for use in these polymerization methods may be water-soluble or oleophilic ones. Exemplary water-soluble polymerization initiators include: persulfates such as potassium persulfate, ammonium persulfate and sodium persulfate; water-soluble azo compounds such as sodium 4,4'-azobis-4-cyanovalerate and 2,2'-azobis(2-aminodipropane)hydrochloride; and hydrogen peroxide. Exemplary oleophilic polymerization initiators include: oleophilic azo compounds such as azobisisobutyronitrile, 2,2'-azobis-2,4-dimethylvale-nitrile, 1,1'-azobis(cyclohexanone-1-carbonitrile), dimethyl 2,2'-azobisisobutyrate, and diethyl 2,2'-azobisisobutyrate; benzoyl peroxide, lauryl peroxide, diisopropyl peroxydicarbonate, and di-t-butyl peroxide.

The following are specific but non-limiting examples of the polymer compound of the present invention, provided that the figures in parentheses denote the weight ratio of comonomers.

A-1) N-(4-hydroxyphenyl)methacrylamide/methyl methacrylate copolymer (60:40);

A-2) N-(2-hydroxy-5-ethanesulfonylphenyl)acrylamide/methyl acrylate copolymer (75:25);

A-3) N-(4-hydroxyphenyl)methacrylamide/N-tert-butyl acrylamide copolymer (50:50);

A-4) N-(4-hydroxyphenyl)methacrylamide/styrene copolymer (72:28);

A-5) N-[4-(4'-hydroxyphenylsulfonyl)phenyl]acrylamide/n-butyl acrylate copolymer (65:35);

A-6) [4-(4'-hydroxyphenylsulfonyl)phenyloxymethyl]styrene (mixture of m- and p-forms)/N-tert-butyl acrylamide copolymer (15:85);

A-7) N-(4-hydroxyphenyl)methacrylamide/methyl methacrylate/N-tert-butyl acrylamide copolymer (30:40:30);

A-8) poly[N-(4-hydroxyphenyl)acrylamide];

A-9) poly(p-hydroxystyrene);

A-10) poly(m-hydroxystyrene);

A-11) N-[4-(4'-hydroxyphenylsulfonyl)phenyl]acrylamide/vinyl acetate copolymer (55:45);

A-12) p-hydroxystyrene methyl methacrylate copolymer (70:30);

A-13) N-(3-hydroxyphenyl)vinyl sulfonamide/ethyl acrylate/acrylic acid copolymer (20:75:5);

A-14) poly(vinyl p-hydroxybenzoate);

A-15) N-[4-4'-hydroxyphenylsulfonyl)phenyl]methacrylamide/methyl methacrylate copolymer (75:25);

A-16) p-hydroxystyrene/N-tert-butyl acrylamide copolymer (60:40);

A-17) m-hydroxystyrene/N-vinylpyrrolidone copolymer (90:10);

A-18) m-hydroxystyrene/acrylonitrile/vinylidene chloride copolymer (35:25:40);

A-19) p-hydroxystyrene/2-methoxyethyl acrylate copolymer (30:70); and

A-20) vinyl p-hydroxybenzoate/methyl methacrylate copolymer (40:60).

A specific method of synthesizing polymer compound (A-5) of the present invention is described below.

Synthesis of monomer (17), N-[4-(4 -hydroxyphenylsulfonyl) phenyl]-acrylamide:

A mixture of 4-(4'-hydroxyphenylsulfonyl)aniline (23.3 g), pyridine (9.4 g) and nitrobenzene (1 ml) is added to 400 ml of tetrahydrofuran. To the ice-cooled solution, 9.0 g of acrylic acid chloride is added dropwise and stirred for 30 min. The stirred mixture is added to 2,000 ml of water and the precipitating crystal is separated by filtration. The resulting crystal is recrystallized with ethanol to obtain the end compound in an amount of 28.5 g. The structure of this compound is verified by IR, NMR and mass spectra.

Polymerization

A mixture of N-[4-(4'-hydroxyphenylsulfonyl)phenyl] acrylamide (6.5 g), n-butyl acrylamide (3.5 g) and DMF (100 ml) is stirred in a nitrogen stream at 80° C. To the stirred mixture, 0.5 g of dimethyl-2,2'-azobisisobutyrate dissolved in 5 ml of DMF is added and reaction is performed for 6 h. The reacted DMF solution is added dropwise to 2,000 ml of water and the precipitating solids are separated by filtration. After washing with water, the solids are dried to obtain the end product in an amount of 9.5 g.

The number average molecular weight of the polymer compound of the present invention is not limited to any particular value but is preferably not more than $2\times10^5$, more preferably in the range of $5\times10^3$ to $1\times10^5$.

The weight ratio of the polymer compound of the present invention to a hydrophobic, photographically useful material is preferably within the range of from 1:20 to 20:1, more preferably in the range of from 1:10 to 10:1.

Examples of the hydrophobic, photographically useful material that may be used in the present invention include dye image forming couplers, uv absorbers, anti-fading agents, anti-color mixing agents, redox compounds, anti-foggants, etc.

Dye image forming couplers that are used with particular preference in the present invention are described below. Illustrative yellow dye image forming couplers include benzoyl acetanilide and pivaloyl acetanilide type couplers. Illustrative magenta dye image forming couplers include 5-pyrazolone, pyrazolotriazole, imidazopyrazole, pyrazolopyrazole, pyrazolotetrazole, pyrazolinobenzimidazole, and indazolone based couplers. Illustrative cyan dye image forming couplers include phenolic, naphtholic and pyrazoloquinazolone based couplers. Specific examples of these yellow, magenta and cyan dye forming couplers are known in the photographic industry and all of the known dye image forming couplers are included within the scope of the present invention.

Typical examples of yellow dye image forming couplers that can be used in the present invention are listed below.

Y-1

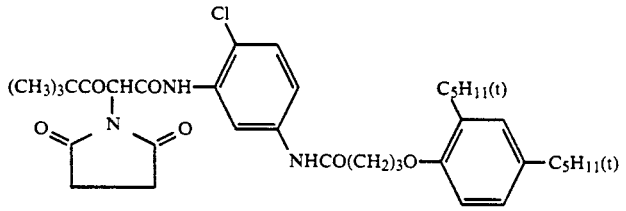

Y-2

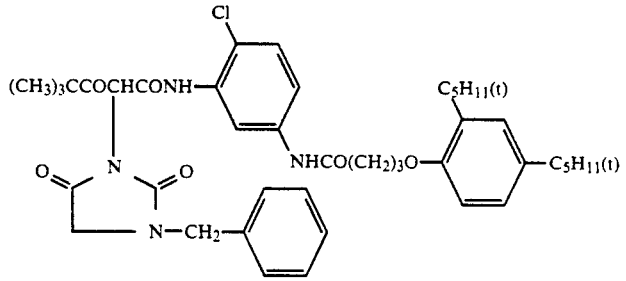

-continued
Y-3
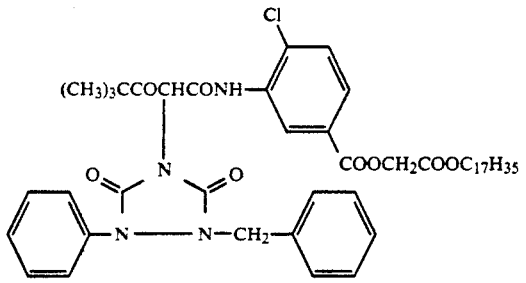
Y-4
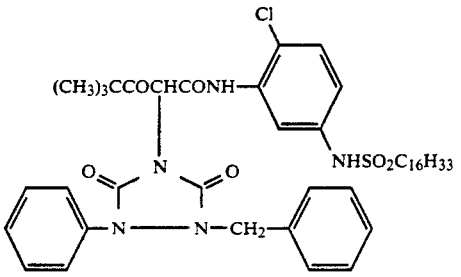
Y-5
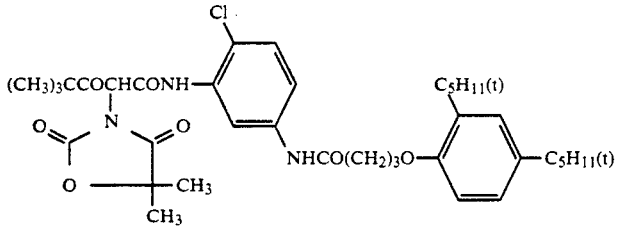
Y-6
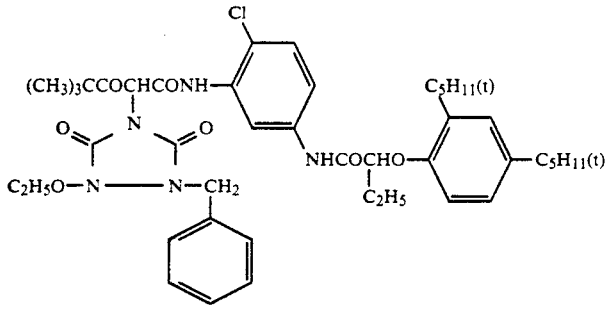
Y-7
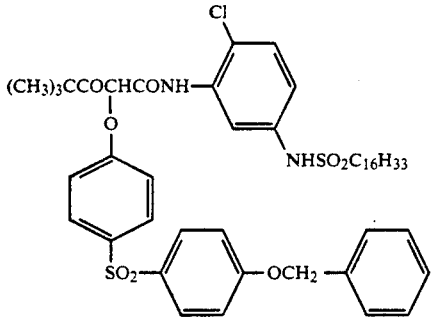
These yellow dye image forming couplers embrace the compounds described in, for example, German Patent Application (OLS) Nos. 2,057,941, 2,163,812, 1,491,616, U.S. Pat. Nos. 4,404,234, 3,730,722, 4,057,452, 4,133,958, 4,022,620, 4,314,023, 4,314,023, 4,008,086, 4,008,086 and 4,314,023, and they can be synthesized by the methods described in the patents.
Typical examples of magenta dye image forming couplers that can be used in the present invention are listed below.

M-1
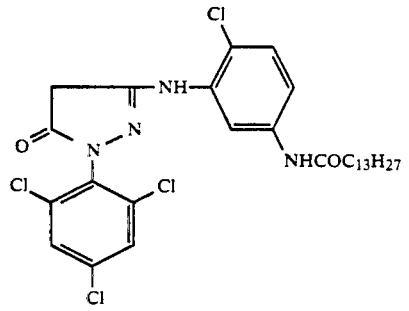
M-2
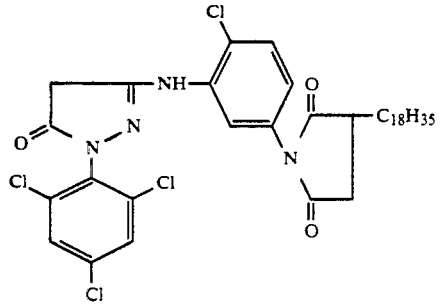
M-3
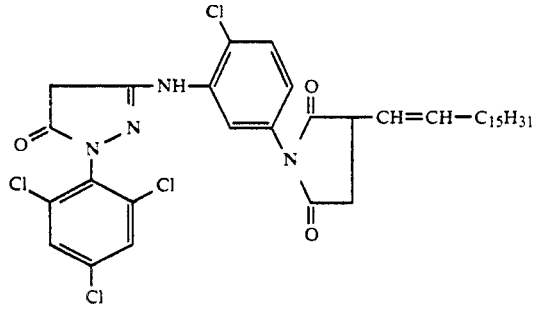
M-4
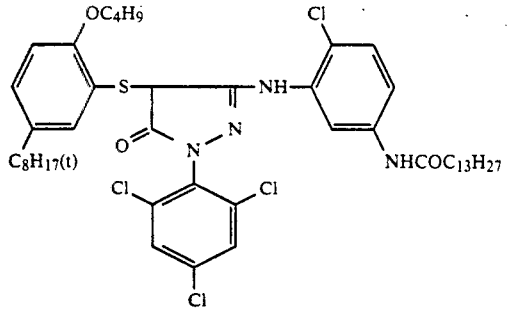
M-5
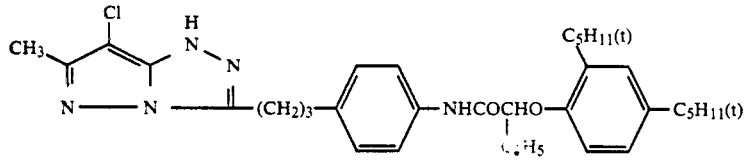
M-6
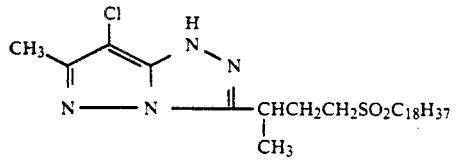

-continued
M-7
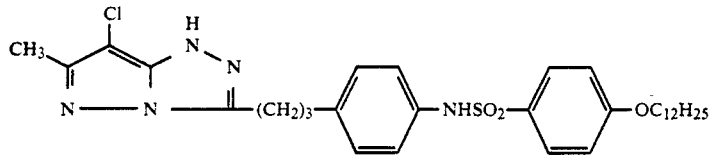
M-8
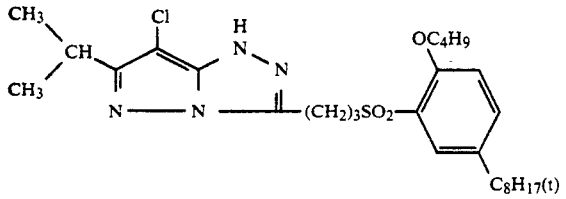
M-9
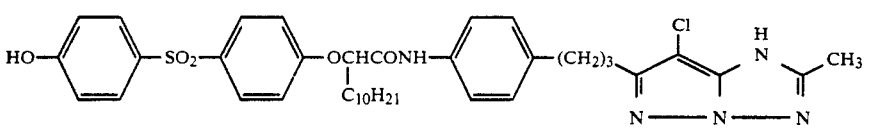
M-10
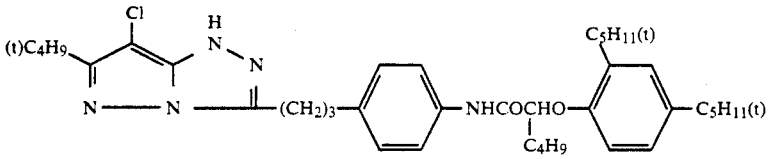
M-11
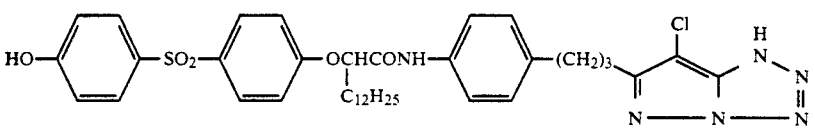
M-12
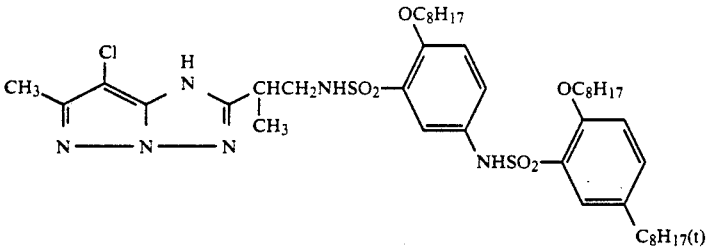
M-13
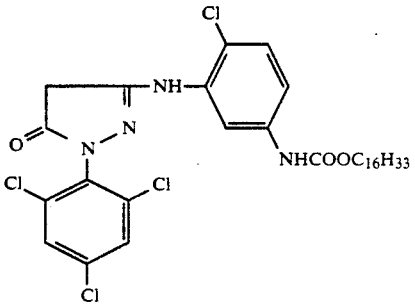

-continued

M-14

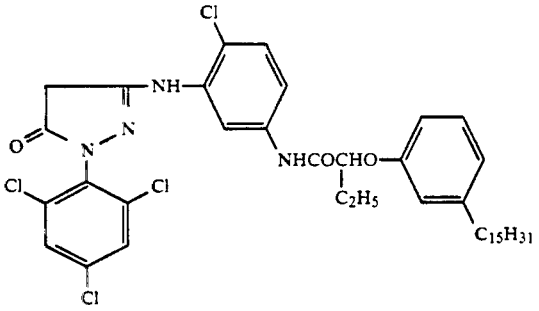

M-15

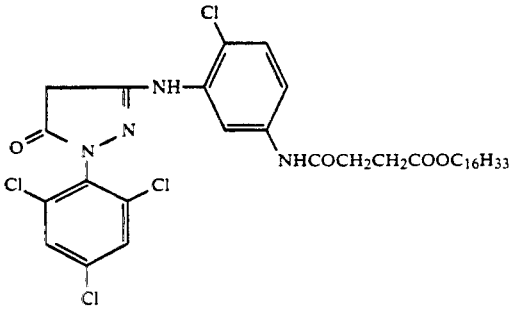

M-16

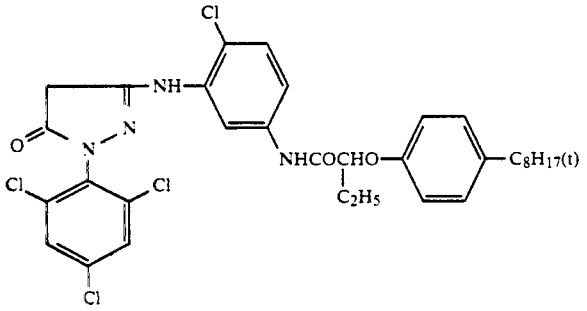

M-17

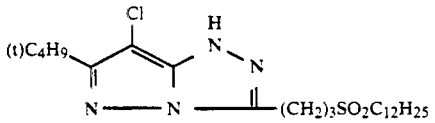

These magenta dye image forming couplers embrace the compounds described in, for example, U.S. Pat. No. 3,684,514, British Patent No. 1,183,515, U.S. Pat. No. 3,725,067, British Patent Nos. 1,252,418 and 1,334,515, and Research Disclosure No. 24626 (1984), and they can be synthesized by the methods described in these documents.

The cyan dye image forming couplers that can be used in the present invention are in no way limited but they are preferably phenolic cyan dye image forming couplers. The following are typical examples of cyan dye image forming couplers.

C-1

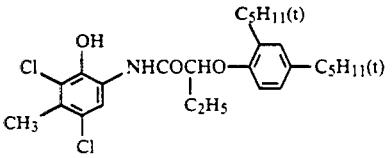

-continued

C-2

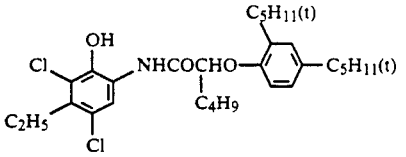

C-3

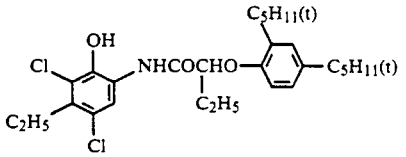

C-4

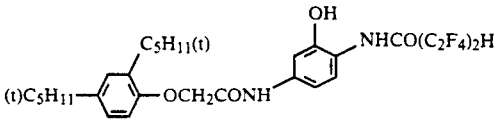

-continued

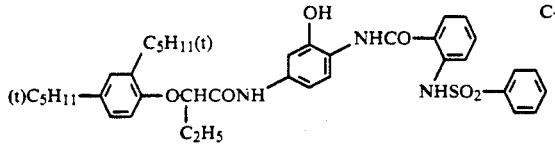

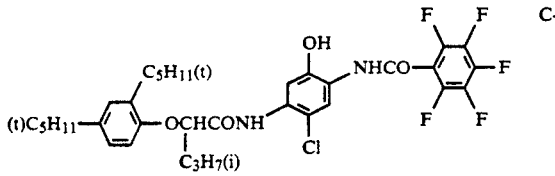

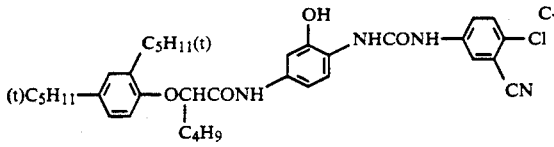

These cyan dye image forming couplers embrace the compounds described in, for example, U.S. Pat. Nos. 2,423,730 and 2,801,171, and they can be synthesized by the methods described in these patents.

The dispersion of the hydrophobic, photographically useful material and the polymer compound of the present invention may be prepared by the following procedure First, they are dissolved in a low-boiling point organic solvent and/or a water-soluble organic solvent as required, and emulsified and dispersed in a hydrophilic binder such as an aqueous gelatin solution in the presence of a surfactant by suitable dispersing means such as a stirrer, a homogenizer, a colloid mill, a flow-jet mixer or an ultrasonic apparatus. The thus prepared dispersion is added to a hydrophilic colloidal layer of interest. The low-boiling point organic solvent and/or water-soluble organic solvent may be removed from the resulting dispersion by some suitable method such as evaporation, noodle washing or ultrafiltration.

Illustrative low-boiling point organic solvents include ethyl acetate, butyl acetate, ethyl propionate, sec-butyl alcohol, methyl ethyl ketone, methyl isobutyl ketone, β-ethoxyethyl acetate, methyl cellosolve acetate and cyclohexanone. Illustrative water-soluble organic solvents include methyl alcohol, ethyl alcohol, acetone and tetrahydrofuran. These organic solvents may be used either independently or in combination with themselves as required. Another method of preparing the dispersion of the hydrophobic, photographically useful material and the polymer compound of the present invention is described in JP-A-60-107642. According to this method, the monomer component or components of the polymer compound of the present invention are subjected to suspension polymerization, solution polymerization or bulk polymerization in the presence of the hydrophobic, photographically useful material and the resulting polymer is emulsified and dispersed in a hydrophilic binder by the method already described above.

The further method of preparing the dispersion of the hydrophobic, photographically useful material and the polymer compound of the present invention is described in U.S. Pat. No. 4,199,363, JP-A-58-17,152, JP-A-60-18,541, JP-A-62-96,941 and JP-A-63-43,903. According to this method, the polymer compounds are emulsified and dispersed and then the resulting dispersion is loaded with the hydrophobic, photographically useful material.

The thus prepared dispersion of the hydrophobic, photographically useful material and the polymer compound of the present invention may contain a high-boiling point organic solvent selected from among those organic solvents which have boiling points not lower than 150° C and that will not react with the oxidation product of developing agents, such as phenolic derivatives, phthalate esters, phosphate esters, citrate ester, benzoate ester, alkylamides, aliphatic acid esters and trimesic acid esters.

The dispersion described above is preferably incorporated in silver halide emulsion layers. Any silver halide can be used in the present invention, as illustrated by silver chloride, silver bromide, silver iodide, silver chlorobromide, silver iodobromide, and silver chloroiodide. If rapid processing is required as in the case of processing color paper, silver halide grains having a silver chloride content of at least 90 mol % are preferably used, with the silver bromide and silver iodide contents being preferably not more than 10 mol % and 0.5 mol %, respectively. Silver chloro-bromide grains with a silver bromide content of 0.1–2 mol % are more preferred. Such silver halide grains may be used either independently or in admixture with other silver halide grains having different compositions. If desired, they may be used in admixture with silver halide grains having a silver chloride content of not more than 90 mol %. If silver halide grains having a silver chloride content of more than 90 mol % are to be incorporated in a silver halide emulsion layer, those silver halide grains generally occupy at least 60 wt %, preferably at least 80 wt %, of the total silver halide grains in said emulsion layer.

Gelatin is advantageously used as a binder in the present invention but other hydrophilic colloids may also be used, as illustrated by gelatin derivatives, graft polymers of gelatin and other high-molecular weight compounds, proteins other than those mentioned above, sugar derivatives, cellulose derivatives, and synthetic hydrophilic high-molecular weight materials such as homo- and copolymers.

Dye image forming couplers to be used in the silver halide photographic material of the present invention are commonly selected in such a way that dyes that absorb light to which the emulsion layers have spectral sensitivity will be formed in the respective emulsion layers. Thus, a yellow dye image forming coupler is used in a blue-sensitive emulsion layer, a magenta dye image forming coupler in a green-sensitive emulsion layer, and a cyan dye image forming coupler in a red-sensitive emulsion layer. However, depending on the object, other combinations of couplers may be employed to form a specific silver halide color photographic material.

To form image, the photographic material of the present invention may be subjected to any of the color development processes known in the art. The color developing agent to be used in color developers in accordance with the present invention may be selected from known compounds that are used extensively in various color photographic processes. Suitable developing agents include aminophenolic and p-phenylenediamino derivatives. These compounds are used in the form of salts, such as hydrochlorides or sulfates, which are stabler than when those compounds are in the free state. These compounds are used at concentrations that generally range from about 0.1 g to about 30 g, more preferably from about 1 g to about 15 g, per liter of color developer.

Illustrative aminophenolic developers include o-aminophenol, p-aminophenol, 5-amino-2-hydroxytoluene, 2-amino-3-hydroxytoluene, 2-hydroxy-3-amino-1,4-dimethylbenzene. Particularly useful primary aromatic amino color developing agents are N,N-dialkyl-p-phenylenediamino compounds, in which the alkyl and phenyl groups may have any suitable substitutents. Particularly useful compounds may be exemplified by, for example, N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, and 4-amino-N-(2-methoxyethyl)-N-ethyl-3-methylaniline-p-toluenesulfonate.

Besides these primary aromatic amino color developing agents, compounds that are known components of developers may be added to the color developer for use in processing the silver halide photographic material of the present invention, and they include alkali agents such as sodium hydroxide, sodium carbonate and potassium carbonate, as well as alkali metal sulfites, alkali metal bisulfites, alkali metal thiocyanates, alkali metal halides, benzyl alcohol, water softeners and thickening agents.

The pH of the color developer is generally at least 7, most commonly in the range of from about 10 to 13. Color development is usually performed at a temperature of at least 15° C., more commonly in the range of 20°-50° C. For rapid development, temperatures of at least 30° C. are preferred.

The silver halide photographic material of the present invention is preferably processed with a color developer that is free from benzyl alcohol.

After color development, the silver halide photographic material of the present invention is subjected to bleaching and fixing treatments. Bleaching may be performed simultaneously with fixing. While many compounds are usable as bleaching agents, compounds of polyvalent metals such as iron (III), cobalt (III) and copper (II) are typical. In particular, complex salts of these polyvalent metal cations and organic acids such as aminopolycarboxylic acids (e.g. ethylenediaminetetraacetic acid, nitrilotriacetic acid and N-hydroxyethylethylenediaminediacetic acid), malonic acid, tartaric acid, malic acid, diglycolic acid and dithioglycolic acid, or ferricyanates and bichromates may be used either independently or in appropriate combinations.

Soluble complexing agents that solubilize silver halides as complex salts may be used as fixing agents. Examples of such soluble complexing agents include sodium thiosulfate, ammonium thiosulfate, potassium thiocyanate, thiourea and thioether.

After fixing, the photographic material is usually washed with water. Washing with water may be replaced by a stabilizing treatment. If desired, both washing and stabilizing treatments may be performed.

The following examples for the purpose of further illustrating the present invention but are in no way to be taken as limiting.

EXAMPLE 1

A paper base laminated with polyethylene on one side and with $TiO_2$ containing polyethylene on the other side in contact with the first layer was coated with layers in accordance with the arrangement shown in Table 1, to thereby fabricate a multi-layered silver halide color photographic material (sample No. 101). The necessary coating solutions were prepared in the following manner.

Preparation of a dispersion of cyan dye image forming coupler

Twelve grams of a cyan dye image forming coupler (C-2), 10 g of a high-boiling point organic solvent (DBP) and 18 g of polymer compound (A-5) of the present invention having an average molecular weight of ca. $2\times10^4$ were dissolved in 40 ml of ethyl acetate. Using a homogenizer, the resulting solution was emulsified and dispersed in 200 ml of a 10% aqueous gelatin solution containing 10 ml of a solution of 10% sodium alkylnaphthalenesulfonate, to thereby form a dispersion of the cyan dye image forming coupler.

The resulting dispersion was mixed with a red-sensitive silver chlorobromide emulsion (30 mol % AgCl; 70 mol% AgBr; 10 g in terms of silver) and a coating gelatin solution to prepare a coating solution for the fifth layer. Coating solutions for the other layers were similarly prepared as shown in Tables 1 and 2.

As a gelatin hardener, compound H-1 (see below) was added in an amount of 0.08 g/m$^2$.

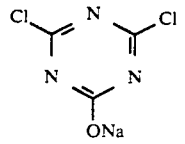

H-1

TABLE 1

| Layer | Composition | Amount, g/m$^2$ |
|---|---|---|
| 7th layer (protective layer) | Gelatin | 1.0 |
| 6th layer (uv absorbing layer) | Gelatin | 0.6 |
| | uv absorber (UV-1) | 0.2 |
| | uv absorber (UV-2) | 0.2 |
| | Anti-color mixing agent (HQ-1) | 0.01 |
| | DBP | 0.2 |
| 5th layer (red-sensitive layer) | Gelatin | 1.40 |
| | Red-sensitive AgClBr emulsion (30% AgCl, 70% AgBr), as Ag | 0.24 |
| | Cyan dye image forming coupler (see Table 2) | 0.7* |
| | Polymer compound of the present invention (see Table 2) | 0.53 |
| | DBP | 0.30 |
| 4th layer (uv absorbing layer) | Gelatin | 1.30 |
| | uv absorber (UV-1) | 0.40 |
| | uv absorber (UV-2) | 0.40 |
| | Anti-color mixing agent (HQ-1) | 0.03 |
| | DBP | 0.40 |
| 3rd layer (green-sensitive layer) | Gelatin | 1.40 |
| | Green-sensitive AgClBr emulsion (30% AgCl, 70% AgBr), as Ag | 0.21 |
| | magenta dye image forming coupler (see Table 2) | 0.7* |
| | Dye image stabilizer (ST-1) | 0.20 |
| | Dye image stabilizer (ST-2) | 0.10 |
| | Anti-stain agent (HQ-1) | 0.01 |
| | Polymer compound of the | 0.60 |

TABLE 1-continued

| Layer | Composition | Amount, g/m² |
|---|---|---|
| | present invention (see Table 2) | |
| | DBP | 0.30 |
| 2nd layer (intermediate layer) | Gelatin | 1.20 |
| | Anti-color mixing agent (HQ-1) | 0.12 |
| | DBP | 0.15 |
| 1st layer (blue-sensitive layer) | Gelatin | 1.30 |
| | Blue-sensitive AgClBr emulsion (10% AgCl, 90% AgBr), as Ag | 0.30 |
| | Yellow dye image forming coupler (see Table 2) | 1.0* |
| | Anti-stain agent (HQ-1) | 0.02 |
| | Polymer compound of the present invention (see Table 2) | 0.82 |
| | DBP | 0.40 |
| Base | Polyethylene-laminated paper | |

*millimole/m²

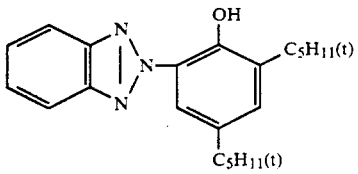

UV-1

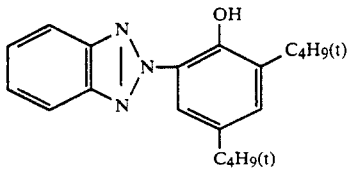

UV-2

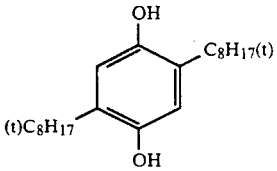

HQ-1

(dibutyl phthalate)

DBP

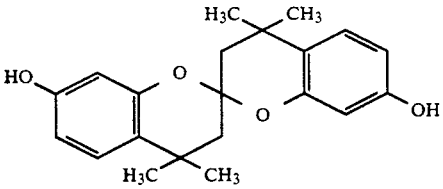

ST-1

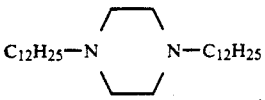

ST-2

Comparative polymer compound 1

-continued

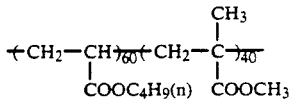

Comparative polymer compound 2

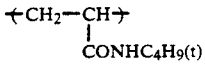

Additional samples (Nos. 102–110) were fabricated by repeating the same procedure as described above except that the type of dye image forming couplers in the first, third and fifth layers, the type of polymer compound of the present invention and the amount of DBP were changed as shown in Table 2.

The samples thus fabricated were exposed through an optical wedge in a sensitometer Model KS-7 (Konica Corp.) and subsequently processed in accordance with the scheme shown below.

| Processing steps | Time | Temperature, °C. |
|---|---|---|
| Color development | 3 min and 30 sec | 33 |
| Bleach-fixing | 1 min and 30 sec | 33 |
| Washing | 3 min | 33 |

| Formula of color developer | |
|---|---|
| N-Ethyl-N-β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Anhydrous sodium sulfite | 2.0 g |
| Benzyl alcohol | 13 ml |
| Polyethylene glycol (average degree of polymerization, 400) | 3.0 ml |
| Water | to make 1,000 ml |
| pH adjusted to 10.0 with sodium hydroxide. | |
| Formula of bleach-fixing solution | |
| Ethylenediaminetetraacetic acid iron (III) sodium salt | 6.0 g |
| Ammonium thiosulfate | 100 g |
| Sodium bisulfite | 10 g |
| Sodium metabisulfite | 3 g |
| Water | to make 1,000 ml |
| pH adjusted to 7.0 with aqueous ammonia. | |

The processed samples were subjected to the following measurements.

Color forming ability

Maximum color reflection density measurements were conducted with an optical densitometer (Model PDA-65 of Konica Corp.).

Deterioration of surface gloss

The samples were stored for 7 days at 85° C. and at a relative humidity of 60%. The surface gloss (%) of each sample was measured with a glossmeter (Tokyo Denshoku Co., Ltd.) at an incident angle of 60°. The results of the measurements are shown in Table 2.

TABLE 2

| | First layer | | | Third layer | | | Fifth layer |
|---|---|---|---|---|---|---|---|
| Sample No. | Yellow coupler | Polymer compound | DBP g/m² | Magenta coupler | Polymer compound | DBP g/m² | Cyan coupler |
| 101 | Y-2 | A-5 | 0.40 | M-8 | A-5 | 0.30 | C-2 |
| 102 | Y-2 | A-5 | 0.20 | M-8 | A-5 | 0.10 | C-2 |
| 103 | Y-2 | A-3 | 0.20 | M-8 | A-3 | 0.10 | C-2 |

TABLE 2-continued

| | | | | | | | |
|---|---|---|---|---|---|---|---|
| 104 | Y-2 | A-6 | 0.20 | M-8 | A-6 | 0.10 | C-2 |
| 105 | Y-7 | A-6 | 0.20 | M-4 | A-6 | 0.10 | C-2 |
| 106 | Y-7 | A-6 | — | M-4 | A-6 | — | C-2 |
| 107 | Y-2 | A-5 | 0.15 | M-17 | A-3 | 0.12 | C-2 |
| 108 | Y-2 | Comparative polymer compound 1 | 0.40 | M-17 | Comparative polymer compound 1 | 0.30 | C-2 |
| 109 | Y-2 | Comparative polymer compound 1 | — | M-17 | Comparative polymer compound 1 | — | C-2 |
| 110 | Y-7 | Comparative polymer compound 2 | — | M-4 | Comparative polymer compound 2 | — | C-2 |

| Sample No. | Fifth layer Polymer compound | Fifth layer DBP g/m² | Maximum color density Yellow | Magenta | Cyan | Surface gloss after storage (%) | Remarks |
|---|---|---|---|---|---|---|---|
| 101 | A-5 | 0.30 | 2.22 | 2.63 | 2.48 | 89 | The present invention |
| 102 | A-5 | 0.10 | 2.18 | 2.55 | 2.35 | 91 | |
| 103 | A-3 | 0.10 | 2.20 | 2.53 | 2.41 | 90 | |
| 104 | A-6 | 0.10 | 2.16 | 2.49 | 2.36 | 92 | |
| 105 | A-6 | 0.10 | 2.21 | 2.57 | 2.39 | 91 | |
| 106 | A-6 | — | 2.13 | 2.40 | 2.33 | 93 | |
| 107 | A-6 | 0.08 | 2.19 | 2.51 | 2.40 | 91 | |
| 108 | Comparative polymer compound 1 | 0.30 | 2.02 | 2.25 | 2.30 | 83 | Comparision |
| 109 | Comparative polymer compound 1 | — | 1.72 | 1.83 | 1.66 | 90 | |
| 110 | Comparative polymer compound 2 | — | 1.88 | 2.10 | 1.55 | 89 | |

As is clear from Table 2, sample Nos. 101–107 using polymer compounds within the scope of the present invention were satisfactory since they produced high values of maximum color density for yellow, magenta and cyan colors and at the same time, their surface gloss did not deteriorate greatly during storage. Further, these samples had good color forming ability since they did not experience a substantial decrease in maximum color density even when the high-boiling point organic solvent (DBP) was used in a decreasing amount. On the other hand, sample No. 108 which did not use a compound within the scope of the present invention experienced substantial deterioration in surface gloss during storage although it was fairly satisfactory in terms of maximum color density. Other comparative samples (Nos. 109 and 110) which also did not use a compound within the scope of the present invention retained comparatively satisfactory surface gloss after storage but on the other hand, they experienced a substantial decrease in maximum color density.

EXAMPLE 2

Additional samples of multi-layered silver halide color photographic material (Nos. 201–210) were fabricated as in Example 1 except that the compositions of the blue-sensitive AgClBr emulsion in the first layer, the green-sensitive AgClBr emulsion in the third layer and the red-sensitive AgClBr emulsion in the fifth layer were changed to one consisting of 99.5 mol % AgCl and 0.5 mol % AgBr. The type of dye image forming couplers in the first, third and fifth layers, the type of polymer compounds of the present invention and the amount of DBP were the same as shown in Table 2.

The samples thus fabricated were exposed through an optical wedge as in Example 1 and subsequently processed in accordance with the following scheme.

| Processing steps | Temperature, °C. | Time, sec |
|---|---|---|
| Color development | 35.0 ± 0.3 | 45 |
| Bleach-fixing | 35.0 ± 0.5 | 45 |
| Stabilizing | 30–34 | 90 |
| Drying | 60–80 | 60 |

| | |
|---|---|
| Color developer | |
| Pure water | 800 ml |
| Triethanolamine | 10 g |
| N,N-Diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Catechol-3,5-disulfonic acid disodium salt | 1.0 g |
| N-Ethyl-N-β-methanesulfonamidoethyl-3-methyl-4-aminoaniline sulfate | 4.5 g |
| Brightener (4,4'-diaminostilbenedisulfonic acid derivative) | 1.0 g |
| Potassium carbonate | 27 g |
| Water | to make 1,000 ml |
| pH adjusted to 10.10 | |
| Bleach-fixing solution | |
| Ethylenediaminetetraacetic acid iron (III) | |
| Ammonium dihydrate | 60 g |
| Ethylenediaminetetraacetic acid | 3 g |
| Ammonium thiosulfate (70% aq. sol.) | 100 ml |
| Ammonium sulfite (40% aq. sol.) | 27.5 ml |
| Water | to make 1,000 ml |
| pH adjusted to 6.2 with potassium carbonate or glacial acetic acid. | |
| Stabilizing solution | |
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% aq. sol.) | 3.0 g |
| Ammonium sulfite | 3.0 g |
| Brightener (4,4'-diaminostilbenedisulfonic acid derivative) | 1.5 g |

-continued

| Processing steps | Temperature, °C. | Time, sec |
|---|---|---|
| Water | | to make 1,000 ml |
| pH adjusted to 7.0 with sulfuric acid or potassium hydroxide. | | |

The processed samples were stored for 20 days at 85° C. and 60% r.h. and their resistance to dark browning was evaluated by measuring the residual percentage of dye image which initially had a density of 1.0. The results are shown in Table 3 below.

TABLE 3

| Sample No. | Type of couplers and polymer compounds in 1st, 3rd, and 5th layers and the amount of DBP | Maximum cyan density | Residual density (%) | Remarks |
|---|---|---|---|---|
| 201 | Same as in sample No. 101 | 2.38 | 82 | The present invention |
| 202 | Same as in sample No. 102 | 2.25 | 81 | |
| 203 | Same as in sample No. 103 | 2.30 | 80 | |
| 204 | Same as in sample No. 104 | 2.31 | 81 | |
| 205 | Same as in sample No. 105 | 2.28 | 83 | |
| 206 | Same as in sample No. 106 | 2.27 | 85 | |
| 207 | Same as in sample No. 107 | 2.32 | 84 | |
| 208 | Same as in sample No. 108 | 1.95 | 72 | Comparison |
| 209 | Same as in sample No. 109 | 1.53 | 75 | |
| 210 | Same as in sample No. 210 | 1.48 | 73 | |

As is clear from Table 3, sample Nos. 201-207 which used polymer compounds within the scope of the present invention produced a satisfactorily high maximum color density even when they were processed with a color developer containing no benzyl alcohol. Further the image they produced was satisfactorily resistant to dark browning. On the other hand, comparative samples (Nos. 208-210) were poor in both maximum color density and resistance to dark browning. Measurements were also conducted to evaluate the capability of forming yellow and magenta colors. Samples Nos. 201-207 using the polymer compounds within the scope of the present invention were satisfactory informing both yellow and magenta colors at high density. In addition, the images produced had good keeping quality.

EXAMPLE 3

Additional samples were fabricated as in Example 1 except that DBP in the 6th layer is changed to a polymer compound (A-3), (A-6) or (A-13) of the present invention.

The samples thus fabricated were exposed through an optical wedge and subsequently processed us in Example 1.

The processed samples were satisfactory since their surface gloss did not deteriorate greatly during storage.

As will be understood from the foregoing description, the present invention provides a silver halide photographic material that is improved not only in color forming ability and surface gloss after storage but also in the keeping quality of image.

What is claimed is:

1. A silver halide photographic material developable with color developers at a temperature of 20° C. to 50° C., said material comprising at least one photographic layer on a support, said layer containing a dispersion of at least one hydrophobic, dye image forming coupler, and at least one polymer compound formed of at least one monomer selected from the group consisting of (1)
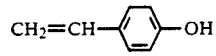

(2)
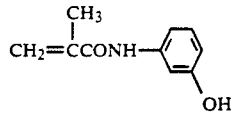

(3)
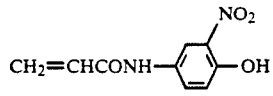

(4)
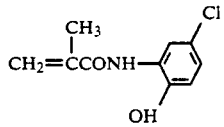

(5)
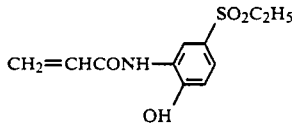

(6)
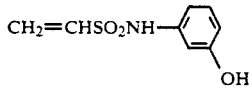

(7)
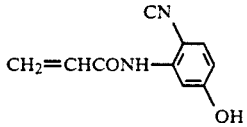

(8)
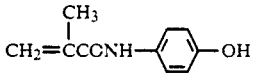

(9)
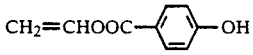

(10)
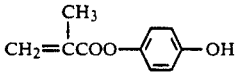

(11)
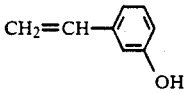

(12)
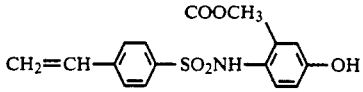

(13)
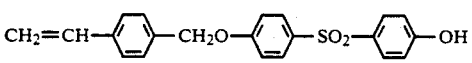

(14)
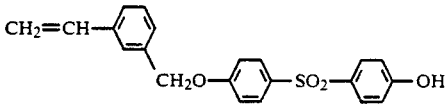

(15)
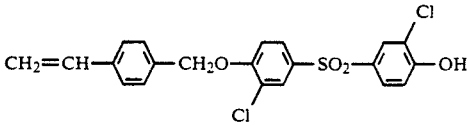

-continued (16)

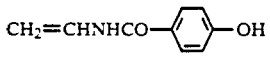

(17)

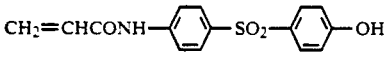

(18)

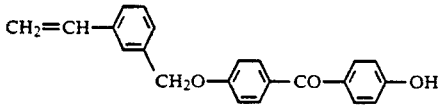

(19)

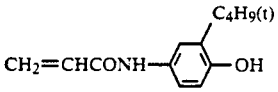

(20)

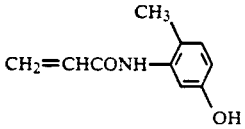

said polymer compound being water-insoluble but soluble in organic solvents.

2. A silver halide photographic material according to claim 1 wherein said polymer compound contains a copolymer formed of said monomer and at least one monomer selected from the group consisting of acrylate, methacrylate, acrylamide and methacrylamide compounds.

3. A silver halide photographic material according to claim 1 wherein said polymer compound has a number average molecular weight of no more than $2\times10^5$.

4. A silver halide photographic material according to claim 1 wherein said polymer compound has a number average molecular weight of from $5\times10^3$ to $1\times10^5$.

5. A silver halide photographic material according to claim 1 wherein the weight ratio of said polymer compound to said hydrophobic, dye image forming coupler is within the range of from 1:20 to 20:1.

6. A silver halide photographic material according to claim 1 wherein the weight ratio of said polymer compound to said hydrophobic, dye image forming coupler is within the range of from 1:10 to 10:1.

7. A silver halide photographic material according to claim 1 wherein said dye image forming coupler is at least one member selected from the group consisting of a benzoyl acetanilide type coupler, a pivaloyl acetanilide type coupler, a 5-pyrazolone based coupler, a pyrazolotriazole based coupler, an imidazole based coupler, a pyrazolopyrazole based coupler, a pyrazolotetrazole based coupler, a pyrazolinobenzimidazole based coupler, an indazolone based coupler, a phenolic coupler, a naphtholic coupler, and a pyrazoloquinazolone based coupler.

8. A silver halide photographic material according to claim 1 wherein the silver halide grains contained in said photographic constituent layer has a silver chloride content of at least 90 mol%, a silver bromide content of no more than 10 mol%, and a silver iodide content of no more than 0.5 mol%.

* * * * *